US006661390B2

(12) United States Patent
Gau et al.

(10) Patent No.: US 6,661,390 B2
(45) Date of Patent: Dec. 9, 2003

(54) POLARIZED WAVE RECEIVING APPARATUS

(75) Inventors: Jiahn-Rong Gau, Taipei Hsien (TW); Cheng-Geng Jan, Taipei Hsien (TW); Chung-Min Lai, Taipei Hsien (TW)

(73) Assignee: Winstron NeWeb Corporation (TW)

( * ) Notice: Subject to any disclaimer, the term of this patent is extended or adjusted under 35 U.S.C. 154(b) by 0 days.

(21) Appl. No.: 10/102,788

(22) Filed: Mar. 22, 2002

(65) Prior Publication Data

US 2003/0030590 A1 Feb. 13, 2003

(30) Foreign Application Priority Data

Aug. 9, 2001 (TW) ..... 90213599 U

(51) Int. Cl.[7] ..... H01Q 13/00
(52) U.S. Cl. ..... 343/786; 343/772
(58) Field of Search ..... 343/786, 772, 343/771, 776, 783; 333/21 A, 135

(56) References Cited

U.S. PATENT DOCUMENTS 6,166,704 A * 12/2000 Jan et al. ..... 343/840
6,445,356 B1 * 9/2002 Yuanzhu ..... 343/786
6,507,323 B1 * 1/2003 West ..... 343/772

* cited by examiner

*Primary Examiner*—Jim Clinger
(74) *Attorney, Agent, or Firm*—Michael D. Bednarek; Shaw Pittman LLP

(57) ABSTRACT

A wave receiving apparatus comprising a reflector; a conduit for guiding waves, having an open end allowing entrance of polarized waves reflected by the reflector; a septum polarizer monolithically formed with the conduit for effecting a circular-linear polarization conversion; a pair of signal collectors pointing to the same direction or towards each other and positioned at a distance of quarter-wavelength away from the rear end of the conduit for receiving wave signals; and a circuitry module, positioned sidelong next to said conduit seen from said open end into said conduit, to which the signal collectors are electrically connected for handling wave signals.

14 Claims, 4 Drawing Sheets

POLARIZED WAVE RECEIVING APPARATUS

REFERENCE TO RELATED APPLICATIONS

The present application claims priority to Taiwan application No. 090213599 entitled "Wave receiving apparatus with parallel feeding elements" filed on Aug. 9, 2001.

BACKGROUND OF THE INVENTION

1. Field of the Invention

The present invention relates to satellite communication technology. More particularly it relates to a wave feed structure for use in conjunction with an antenna dish for receiving satellite signals from space.

2. Description of the Related Art

Satellite communication is gaining importance in this world of real-time digital distribution of audio and video data around the globe. It is known that for the purpose of increasing the data capacity of a satellite system, for example a direct broadcast system (DBS), the technique of giving polarizations to data-carrying waves is commonly utilized. Polarization of an electromagnetic wave refers to the direction of the time-varying electric intensity field vector of the wave traveling in space. A linearly polarized (LP) wave is one whose electric intensity field vector points to a fixed direction, and a circularly or elliptically polarized (CP or EP) wave is one whose electric intensity field vector rotates periodically. Just as a LP wave can be decomposed into horizontal and vertical components in space quadrature, a traveling wave with circular or elliptic polarization can be constructed by superposition of two LP waves in space and time quadrature, that is, a horizontally polarized (HP) wave and a vertically polarized (VP) wave of 90-degree phase difference. In a typical satellite communication system, an antenna in the form of a reflector or dish with particular surface curvature is utilized to focus polarized waves collected from space into a signal feed device, such as a LNBF (Low Noise Block with integrated Feed) module, located in the focal point of the reflector surface. Since the reflector/LNBF assembly is a ground receiver with spatially fixed reception pins for detecting electric fields of waves transmitted from an orbiting satellite, when receiving CP waves characterized by rotating electric fields a device known as polarizer is required to convert CP waves into LP waves with spatially fixed electric fields for easy reception and vice versa.

FIG. 1, FIG. 2, and FIG. 3 illustrate the structure and construction of prior art LNBFs with polarizers. In FIG. 1*a*, LNBF 100 includes a waveguide 110 having a horn opening at one end for receiving polarized waves reflected from an antenna dish which convey audio and video signals in satellite communication. The received waves are guided afterward along the hollow conduit there within. A LNB circuits unit 120 disposed near the sidewall of the waveguide 110 is responsible for adapting the received audio and video signals for output to a TV set or other user device. In the example of FIG. 1*b*, LNBF 150 also includes a waveguide 160 for guiding received waves and a LNB circuits unit 170 for handling the signals contained in the received waves, but the LNB circuits unit 170 is mounted at the rear end of the waveguide 160. The LNBF 100 is shorter in overall length compared to the LNBF 150, and projects a smaller frontal area from a perspective looking into the horn opening. This is advantageous because when two LNBFs are required for an antenna dish capable of simultaneously receiving signals of two satellites, a LNBF with small frontal area allows itself to be more closely bundled with the adjacent one to reduce the lateral distance of the wave-receiving horns so that both can be more closely positioned at the focal point of the antenna dish, thereby upgrading their performance. It should be observed that the relative position between the waveguide and signal handling circuits in a LNBF module is subjected to system design choices.

FIG. 2*a* illustrates a polarizer 200 in the shape of two conducting plates set diametrically on the inner wall of the waveguide 110. The physical effect of the polarizer 200 is to alter the cross-sectional area of waveguide 110 in such a way that one component of an incoming CP wave shifts phase relative to the other component in time quadrature, and the CP wave is converted into two in-phase LP components when the phase shift between them reaches 90 degrees. Another example for producing phase shift in polarized waves is illustrated in FIG. 2*b*, wherein a dielectric slab 210 is added to the conducting waveguide 110 which alters due to changes in dielectric constant the phase velocity of one component of the received CP wave relative to the other to effect the CP/LP conversion.

FIG. 3 is a cross-sectional view of the waveguide 110, showing the polarizer 200 diagonally placed therein and a pair of signal collector pins 310, 320, one horizontal and the other vertical, protruding from the LNB circuits unit 120 into the hollow conduit thereof for collecting signals induced by the electric fields of polarized waves guided there within. Theoretically the conductor polarizer 200, and similarly the dielectric polarizer 210, is capable of converting the incoming CP wave into a LP wave that is to be received by the signal collector pins 310, 320. But in practice the conversion may be incomplete due to an imperfect polarizer or polarization distortions found in the received waves after traveling through the impure medium of atmosphere, so that signal collector pins may experience signal interferences when placed too close to each other. To avoid incomplete conversion, or cross-polarization, and to attain better pin-to-pin isolation, conventional design therefore places the signal collector pins a distance apart from each other along the axis of the waveguide as illustrated in FIG. 4. Usually a separating distance of half wavelength of the received wave is required for acceptable performance. Yet the distancing of the signal collector pins extends the overall length of the waveguide and hence a structurally bulky LNBF is formed.

In addition to the shortcomings of incomplete conversion of polarization and extended structure, conventional LNBF is disadvantageous in that, as shown in FIG. 3 and FIG. 4, the L-shaped collector pin 310 protruding form the LNB circuits unit 120 can not be easily and precisely positioned because it is not straight and conventionally Teflon materials are used to wrap around it which might produce gaps that make pin displacement and rotation possible, thereby causing inaccurate signal reception. Conventional LNBF is also disadvantageous in its manufacture processes. In the case of FIG. 2*a*, the waveguide 110 and the conducting polarizer 200 cannot be integrally formed as one piece by casting due to the shape of the polarizer 200. That is, the closed end portion of the waveguide 110 needs to be fixed to the rest after the cylindrical portion of the waveguide 110 and the conducting polarizer 200 are fabricated. Similarly in the case of FIG. 2*b*, additional step of bonding or gluing the dielectric polarizer 210 to the inner wall of the cylindrical portion of the waveguide 110 is necessary after the waveguide 110 is molded. In both cases, the waveguide/polarizer structure requires extra manual labor in its production.

SUMMARY OF THE INVENTION

The object of the present invention is to overcome the shortcomings of conventional LNBF described in the last section. The present invention consists of a conduit for guiding waves, having an open end allowing entrance of polarized waves reflected by the reflector; a septum polarizer monolithically formed with the conduit for effecting a circular-linear polarization conversion; a pair of signal collectors pointing to the same direction or towards each other and positioned at a distance of quarter-wavelength away from the rear end of the conduit for receiving wave signals; and a circuitry module, positioned sidelong next to said conduit seen from said open end into said conduit to which the signal collectors are electrically connected for handling wave signals.

Under such construction, the manual labor in the manufacture process is reduced by monolithically forming the septum polarizer with the conduit. The frontal area of the wave receiving apparatus is minimized by placing the circuitry module on the side instead of on the back of the wave-guiding conduit. Pin-to-pin isolation is improved by using the septum polarizer that thoroughly divides the conduit. And overall length of the conduit decreases, as the signal collectors are distanced less than half wavelength apart.

BRIEF DESCRIPTION OF THE DRAWINGS

The following detailed description, which is given by way of example, and not intended to limit the scope of the invention to the embodiments described herein, can best be understood in conjunction with the accompanying drawings, in which.

DETAILED DESCRIPTION OF THE INVENTION

Figure 5:
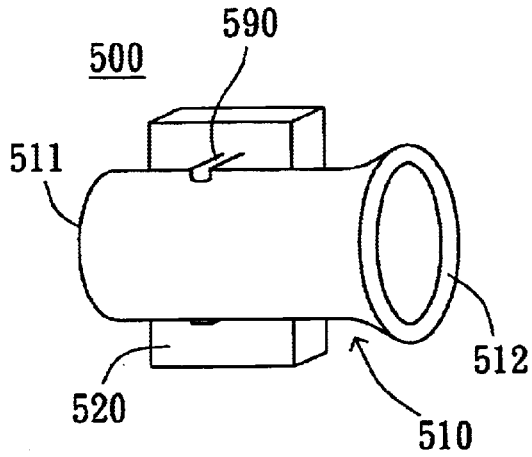
FIG. 5 illustrates the shape of the first embodiment of a polarized wave receiver according to the present invention.

Herein below is presented a detailed description of the present invention conforming to the disclosure requirement according to patent law. First please refer to FIG. 5, which illustrates the shape of the first embodiment of a polarized wave receiver according to the present invention. Polarized wave receiver 500 consists of a hollow waveguide 510 for guiding electromagnetic waves with polarizations and a side-mounted LNB unit 510 for handling signals contained in the received waves. The waveguide 510 includes an open end 512 that has practically a horn-like profile for collecting waves, and is closed at the other end 511 to establish a rear end boundary for the waves propagating therein. As already explained hereinabove, by placing the LNB unit 510 along the sidewall instead of the closed end 511 of the waveguide 510, the wave receiver 500 possesses a reduced frontal area which permits more compact arrangements when applied to a dual-feed satellite antenna system.

Figure 1A:
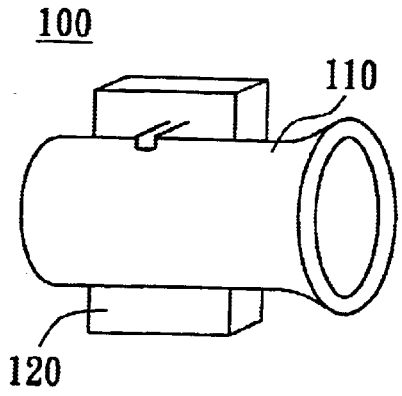
Fig. 1a PRIOR ART
FIG. 1*a* and FIG. 1*b* illustrate the size and shape of two examples of conventional LNBF.
Figure 1B:
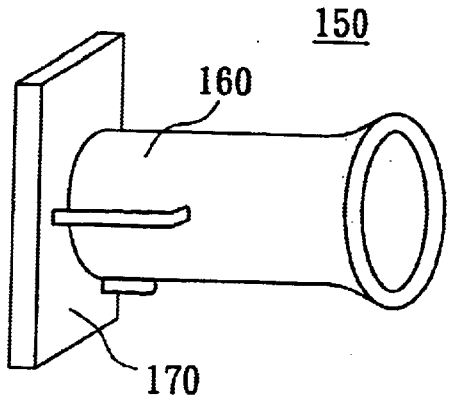
Fig. 1b PRIOR ART
Figure 2A:
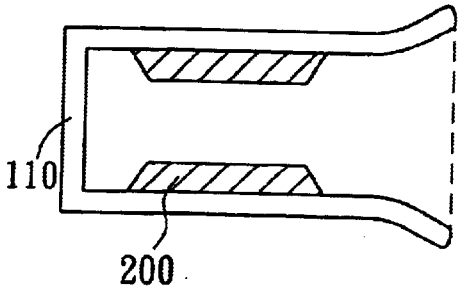
Fig. 2a PRIOR ART
FIG. 2*a* and FIG. 2*b* illustrate two examples of polarizer installed inside a waveguide according to the prior art.
Figure 2B:
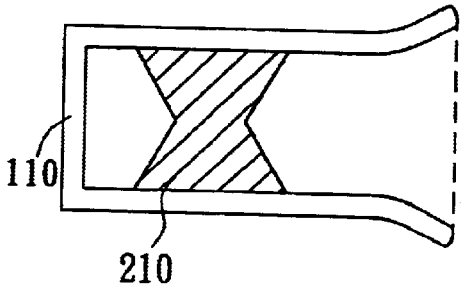
Fig. 2b PRIOR ART
Figure 4:
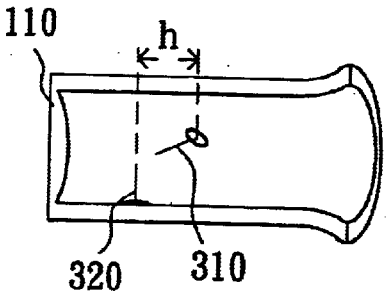
Fig. 4 PRIOR ART
FIG. 4 illustrates how the signal reception pins are distanced form each other in the hollow conduit of waveguide of a conventional LNBF.
Figure 6A:
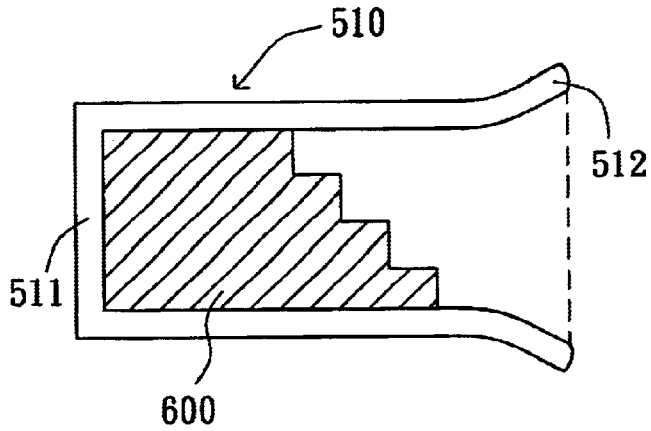
FIG. 6*a* and FIG. 6*b* illustrate the spatial relationship between the polarizer and reception pins in the waveguide of the first embodiment according to the present invention.
Figure 6B:
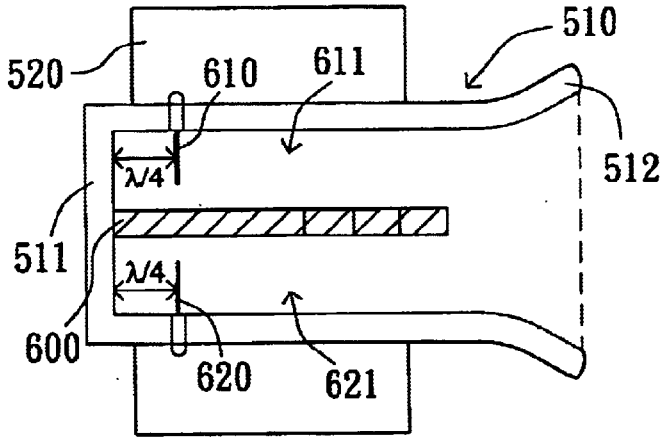

FIG. 6*a* and FIG. 6*b* illustrate the spatial relationship between the polarizer and reception pins in the waveguide of the first embodiment according to the present invention. A septum polarizer 600, with stepped front edge, is longitudinally formed in the waveguide 510 and partitions the waveguide cavity into two in which reception pin 610, 620, both sticking out from the LNB unit 520 with a L shape and hidden inside a linkage structure 590, are located respectively. The septum polarizer 600 is substantially a conducting plate extending longitudinally towards the open end and can therefore be molded monolithically with the waveguide 510 without the shortcomings explained hereinabove of additional manual labor in fixing the rear end of waveguide and gluing dielectric slab. The septum polarizer 600 also works better in effecting CP/LP conversion for it divides the waveguide 510 into two smaller separate waveguides, a structure not realized by the diagonally-placed plate polarizer 200 and dielectric polarizer 210 of FIG. 2, which minimizes the cross-polarization interferences between reception pins 610, 620. This is reflected in the present embodiment that a good pin-to-pin isolation can be obtained even though the reception pins 610, 620 are arranged to lie in the same cross section plane of the waveguide 510 without the requisite quarter-wavelength distancing as shown in FIG. 4. One observes in this regard that the waveguide 510 is made at least a quarter wavelength shorter than those described hereinabove.

The septum polarizer 600 functions with such an effect that a right-hand circularly polarized (RHCP) wave propagating across the feed horn 512 will be converted into a LP wave and at the same time directed to the upper cavity 611 to be received by the reception pin 610 positioned a quarter wavelength from the rear end 511. By the same token, a left-hand circularly polarized (LHCP) wave propagating across the feed horn 512 will be converted into a LP wave directed to the lower cavity 621 to be received by the reception pin 620 which is also positioned a quarter wavelength from the rear end 511. The CP/LP conversion is basically resulted from interactions of waves with the stepped front edge. Accordingly, the reception pins 610, 620 are located after the front edge portion where polarization conversion is completed. It should be understood by one skilled in the art that a septum polarizer with other front edge profiles could also do the same. By properly choosing the length of the polarization-converting portion of the septum polarizer 600 and the relative position of the reception pins 610, 620, a shorter waveguide 510 and hence a more compact polarized wave receiver 500 is obtained.

Figure 3:
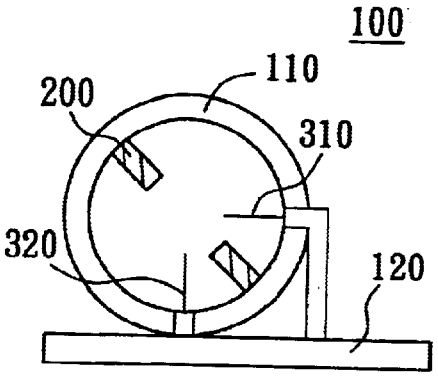
Fig. 3 PRIOR ART
FIG. 3 illustrates how the signal reception pins and the polarizer relate to one another in the hollow conduit of waveguide of a conventional LNBF.
Figure 7:
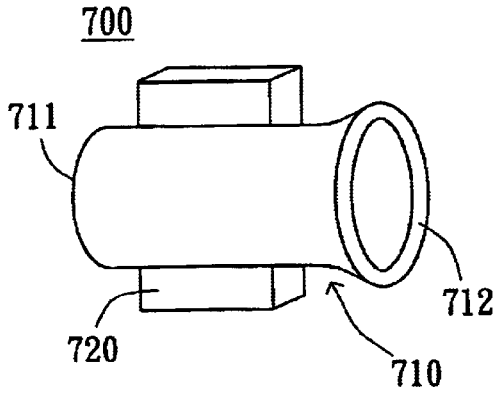
FIG. 7 illustrates the shape of the second embodiment of a polarized wave receiver according to the present invention.

Although the wave receiver 500 in the first example possesses advantages over the prior art, one may observe that it still needs improvement, for the L-shaped reception pins 610, 620 suffer the same problem of imprecise positioning and hence inaccurate reception as described in the example of FIG. 3. The second embodiment of the present invention provides a way to resolve this problem. FIG. 7 illustrates the shape of the second embodiment of a polarized wave receiver according to the present invention. As in the first embodiment, the wave receiver 700 also consists of a LNB unit 720 attached to the side wall of a waveguide structure 710 that is closed at the rear end 711 but open at the opposite end to form a feed horn structure 712 for collecting waves. The main difference in the second embodiment is that the linkage structure 590 requisite for accommodating the L-shaped reception pins in the first embodiment is eliminated, thereby giving the wave receiver 700 a simplified profile.

Figure 8A:
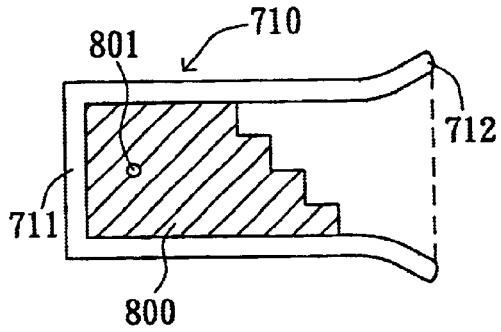
FIG. 8*a*, FIG. 8*b* and FIG. 8*c* illustrate the spatial relationship between the polarizer and reception pins in the waveguide of the second embodiment according to the present invention.
Figure 8B:
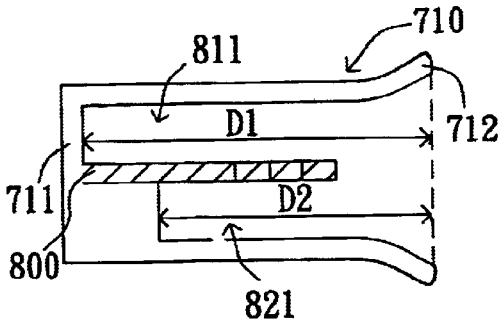
Figure 8C:
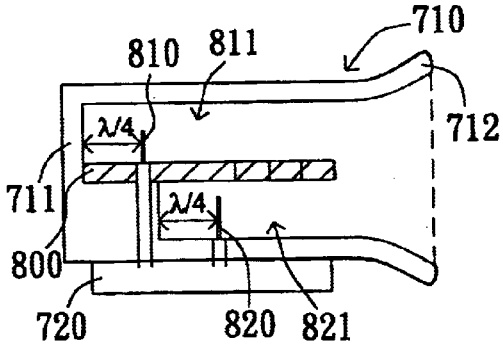

FIG. 8*a*, FIG. 8*b* and FIG. 8*c* illustrate the spatial relationship between the polarizer and reception pins in the waveguide of the second embodiment according to the present invention. The internal structure of the waveguide 710 is similar to the first embodiment, except that, for the purpose of eliminating the L-structure of reception pins and minimizing the problem of imprecise positioning and inaccurate reception thereof, the polarizer 800 separates the waveguide 710 into upper cavity 811 having a greater depth D1 and lower cavity 821 having a depth D2 less than D1. A reception pin 810 in the form of a straight wand sticks out directly from the circuits of the LNB unit 720, and through an opening 801 disposed in an suitable location on the polarizer 800 behind the rear end boundary of the lower cavity 821 protrudes into the upper cavity 811 for receiving LP waves converted from RHCP waves entering into the feed horn 712. Similarly, a straight reception pin 820 sticks out directly from the circuits of the LNB unit 720, and through the side wall of the waveguide 710 protrudes into the lower cavity 821 for receiving LP waves converted from LHCP waves entering into the feed horn 712. One readily observes that the reception pins 810, 820 protrude laterally into waveguide cavities from the same direction, while in the example of FIG. 6*b* the reception pins 610, 620 protrude diametrically from opposite directions. A skilled artist should realize that by rendering the reception pins straight precise positioning and accurate reception could be more easily achieved without the problems of pin displacement and rotation encountered in previous examples.

The reception pin 810 is placed a quarter wavelength away from the rear end of the upper cavity 811, and the reception pin 820 is placed a quarter wavelength away from the rear end of the lower cavity 821. Since the reception pin 810 is behind the rear end boundary of the lower cavity 821, such a construction creates a pin-to-pin distance of no less than a quarter wavelength in the longitudinal direction of the waveguide 710. Even so, it is still possible and beneficial in the present embodiment to limit the distance to less than a half wavelength employed in the example of FIG. 4. In this regard, the overall length of the waveguide 710 and the wave receiver 700 is reduced and the advantage is preserved.

Figure 9:
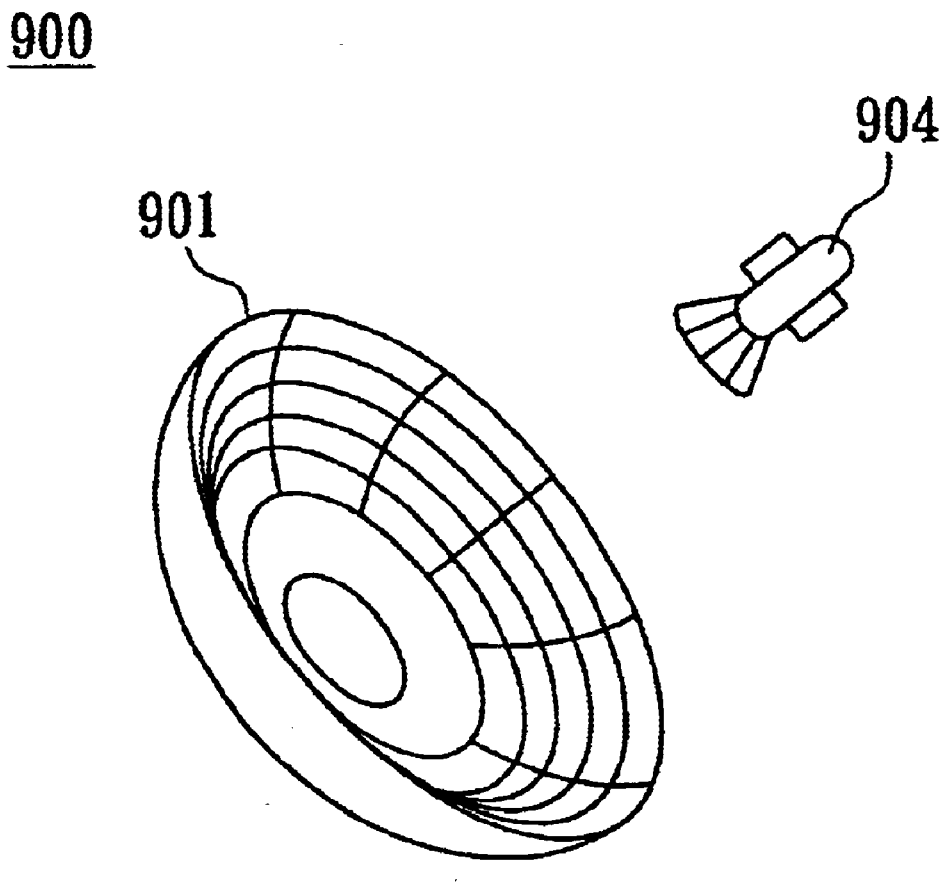
FIG. 9 illustrates one implementation of the present invention with antenna dish

FIG. 9 illustrates one implementation the polarized wave receiver of the present invention with an antenna dish in a satellite antenna system. The satellite antenna system 900 includes an antenna dish or reflector 901 for collecting electromagnetic waves transmitted by a satellite and a wave receiver 904 for receiving and processing the waves collected and reflected by the dish surface. The wave receiver 904 is shorter and more compact than conventional ones and possesses other advantages already described hereinabove. It is placed preferably at the focal point of the antenna dish 901 for best reception if the dish surface is a paraboloid. In dual-feed applications, it may also be placed along with other similar LNBF at the focal point of the antenna dish 901 that has a surface capable of receiving waves from different satellites simultaneously. The present invention is particularly useful under such circumstances due to its reduced size and frontal area.

Having described the present invention, it is noted that the embodiments and particular features and functions as disclosed hereinabove are for the purpose of disclosure only and are not in any sense for limiting the scope of the invention. Small modifications and juxtapositions of one or more of the functional elements anticipated by those skilled in the art without departing the spirit of present invention is to be regarded as a part of the invention. Therefore, that the scope of present invention is determined by the appended claims is fully understood.

What is claimed is:

1. A wave receiving apparatus, comprising:

a conduit for guiding waves, said conduit having an open end allowing entrance of polarized waves and a rear end terminating said conduit;

a septum polarizer monolithically formed with said conduit for effecting a circular-linear polarization conversion, said septum polarizer having a planar structure extending from said rear end of said conduit towards said open end of said conduit;

a pair of L-shaped signal collectors located to opposite sides of said septum polarizer and pointing towards each other for receiving wave signals, both being positioned at a distance of quarter-wavelength away from said rear end of said conduit; and a circuitry module to which said pair of L-shaped signal collectors are electrically connected for handling wave signals, said circuitry module being positioned sidelong next to said conduit seen from said open end into said conduit.

2. The wave receiving apparatus according to claim 1, further comprising a reflector surface for reflecting polarized waves in space into said conduit positioned close to a focal point thereof.

3. The wave receiving apparatus according to claim 2, further comprising an additional feed device positioned close to said focal point of said reflector surface, thereby forming a dual-feed system.

4. The wave receiving apparatus according to claim 1, wherein said open end of said conduit is of a horn-like shape.

5. The wave receiving apparatus according to claim 1, wherein said conduit is of a cylindrical shape.

6. The wave receiving apparatus according to claim 1, wherein said circuitry module is a low noise block (LNB) module.

7. A wave receiving apparatus, comprising:

a conduit for guiding waves, said conduit having an open end allowing entrance of polarized waves and a rear end terminating said conduit;

a septum polarizer monolithically formed with said conduit for effecting a circular-linear polarization conversion, said septum polarizer having a planar structure extending from said rear end of said conduit towards said open end of said conduit and dividing said conduit into two half-conduits having ends with differing depths;

a pair of signal collectors pointing to the same direction and positioned respectively in said half-conduits at a distance of quarter-wavelength away from said respective ends of said conduits for receiving wave signals; and a circuitry module to which said pair of signal collectors are electrically connected for handling wave signals, said circuitry module being positioned sidelong next to said conduit seen from said open end into said conduit.

8. The wave receiving apparatus according to claim 7, further comprising a reflector surface for reflecting polarized waves in space into said conduit positioned close to a focal point thereof.

9. The wave receiving apparatus according to claim 8, further comprising an additional feed device positioned close to a focal point of said reflector surface, thereby forming a dual-feed system.

10. The wave receiving apparatus according to claim 7, wherein said open end of said conduit is of a horn-like shape.

11. The wave receiving apparatus according to claim 7, wherein said conduit is of a cylindrical shape.

12. The wave receiving apparatus according to claim 8, wherein said pair of signal collectors are substantially orthogonal to the septum polarizer.

13. The wave receiving apparatus according to 7, wherein said pair of signal collectors are distanced less than half wavelength apart in said conduit longitudinally.

14. The wave receiving apparatus according to claim 7, wherein said circuitry module is a low noise block (LNB) module.

* * * * *

UNITED STATES PATENT AND TRADEMARK OFFICE

CERTIFICATE OF CORRECTION

PATENT NO. : 6,661,390 B2
APPLICATION NO. : 10/102788
DATED : December 9, 2003
INVENTOR(S) : Jiahn-Rong Gau, Cheng-Geng Jan and Chung-Min Lai It is certified that error appears in the above-identified patent and that said Letters Patent is hereby corrected as shown below:

On the title page, Item (73) Assignee
please replace "Winstron NeWeb Corporation (TW)"
with --Wistron NeWeb Corporation (TW) --.

Signed and Sealed this

Twenty-ninth Day of August, 2006

JON W. DUDAS
*Director of the United States Patent and Trademark Office*